US010093114B2

(12) United States Patent
Oguchi et al.

(10) Patent No.: US 10,093,114 B2
(45) Date of Patent: Oct. 9, 2018

(54) PRINTER

(71) Applicant: FUJITSU COMPONENT LIMITED, Tokyo (JP)

(72) Inventors: Tatsuya Oguchi, Tokyo (JP); Sumio Watanabe, Tokyo (JP); Yukihiro Mori, Tokyo (JP); Masahiro Tsuchiya, Tokyo (JP)

(73) Assignee: FUJITSU COMPONENT LIMITED, Tokyo (JP)

( * ) Notice: Subject to any disclaimer, the term of this patent is extended or adjusted under 35 U.S.C. 154(b) by 0 days.

(21) Appl. No.: 15/648,785

(22) Filed: Jul. 13, 2017

(65) Prior Publication Data

US 2018/0037035 A1 Feb. 8, 2018

(30) Foreign Application Priority Data

Aug. 3, 2016 (JP) ..... 2016-153188

(51) Int. Cl.
*B41J 11/00* (2006.01)
*B41J 11/46* (2006.01)

(52) U.S. Cl.
CPC ..... *B41J 11/0045* (2013.01); *B41J 11/0025* (2013.01); *B41J 11/0095* (2013.01); *B41J 11/46* (2013.01)

(58) Field of Classification Search
CPC ..... B41J 11/02; B41J 11/04; B41J 11/0045; B41J 11/053; B41J 11/057; B41J 11/06; B41J 11/08; B41J 11/10; B41J 11/13
See application file for complete search history.

(56) References Cited

U.S. PATENT DOCUMENTS

| | | | |
|---|---|---|---|
| 6,744,457 | B2 | 6/2004 | Seino et al. |
| 8,419,302 | B2 | 4/2013 | Watanabe et al. |
| 2013/0099412 | A1 | 4/2013 | Komori et al. |

FOREIGN PATENT DOCUMENTS

| | | |
|---|---|---|
| JP | H02-160558 | 6/1990 |
| JP | 2000-086012 | 3/2000 |
| JP | 2003-246104 | 9/2003 |

*Primary Examiner* — Kristal Feggins
(74) *Attorney, Agent, or Firm* — IPUSA, PLLC

(57) ABSTRACT

A printer for printing information on a recording medium includes a guide that guides the recording medium being fed and includes multiple holes, a sensor for detecting the recording medium, and a board that includes multiple terminals. The sensor is mounted on at least one of the terminals such that the sensor is exposed through one of the holes.

6 Claims, 13 Drawing Sheets

PRINTER

CROSS-REFERENCE TO RELATED APPLICATION

The present application is based upon and claims the benefit of priority of Japanese Patent Application No. 2016-153188, filed on Aug. 3, 2016, the entire contents of which are incorporated herein by reference.

BACKGROUND OF THE INVENTION

1. Field of the Invention

An aspect of this disclosure relates to a printer.

2. Description of the Related Art

Printers are widely used, for example, for cash registers in shops, automated teller machines (ATM), and cash dispensers (CD). In a type of printer, a roll of recording paper is used. The recording paper is placed between a print head and a platen roller, and information is printed while feeding the recording paper by rotating the platen roller.

Such a printer includes a sensor for detecting the recording paper being fed (see, for example, Japanese Patent No. 2585769, Japanese Laid-Open Patent Publication No. 2000-86012, and Japanese Laid-Open Patent Publication No. 2003-246104).

Recording papers for printers come in various widths such as two inches, three inches, and four inches. If printer mechanisms are produced for respective recording papers with different widths, types of printers increase and the costs of printers also increase.

There exists, a recording paper on which a black mark is printed beforehand to enable a printer to detect a printing start position. However, the related-art printer cannot detect black marks printed on recording papers with different widths.

SUMMARY OF THE INVENTION

In an aspect of this disclosure, there is provided a printer for printing information on a recording medium. The printer includes a guide that guides the recording medium being fed and includes multiple holes, a sensor for detecting the recording medium, and a board that includes multiple terminals. The sensor is mounted on at least one of the terminals such that the sensor is exposed through one of the holes.

DESCRIPTION OF EMBODIMENTS

An aspect of this disclosure provides a printer that can detect black marks printed on recording media with different widths.

Embodiments of the present invention are described below with reference to the accompanying drawings. The same reference number is assigned to the same component, and repeated descriptions of the same component are omitted.

Comparative Example

A printer according to a comparative example is described. The printer supports recording media with widths of two inches, three inches, and four inches (which are hereafter referred to as "two-inch medium", "three-inch medium", and "four-inch medium"). The widths of recording media are not limited to these examples.

Figure 1:
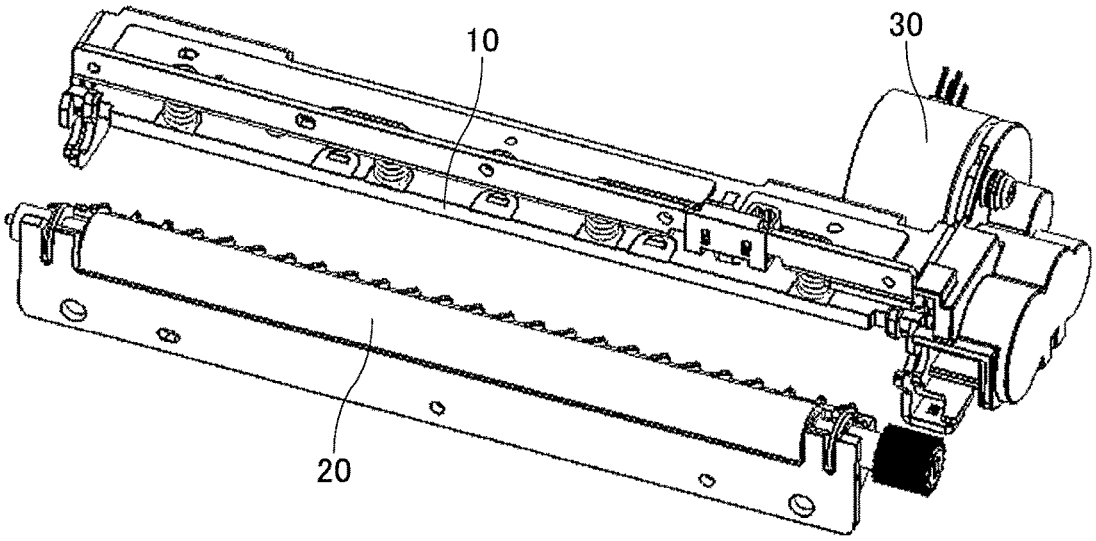
FIG. 1 is a drawing illustrating a printer.

The printer of the comparative example includes a printer mechanism illustrated in FIG. 1 that supports a four-inch medium. The printer mechanism includes a thermal head 10 that is a print head, a platen roller 20, and a motor 30 for rotating the platen roller 20. The printer uses a rolled recording medium, which is a thermal paper, and prints information on the recording medium sandwiched between the thermal head 10 and the platen roller 20. Parts of the recording medium heated by print dots of the thermal head 10 change color, and information is thereby printed on the recording medium.

In the comparative example, a detection of a black mark printed on each of a two-inch medium, a three-inch medium, and a four-inch medium with the printer that supports these recording media and includes the printing mechanism supporting the four-inch medium shall be discussed. If the black mark is printed in the center of each recording medium, the printable area of the recording medium is reduced. Therefore, the black mark is printed at an edge of each recording medium in the width direction.

Figure 2:
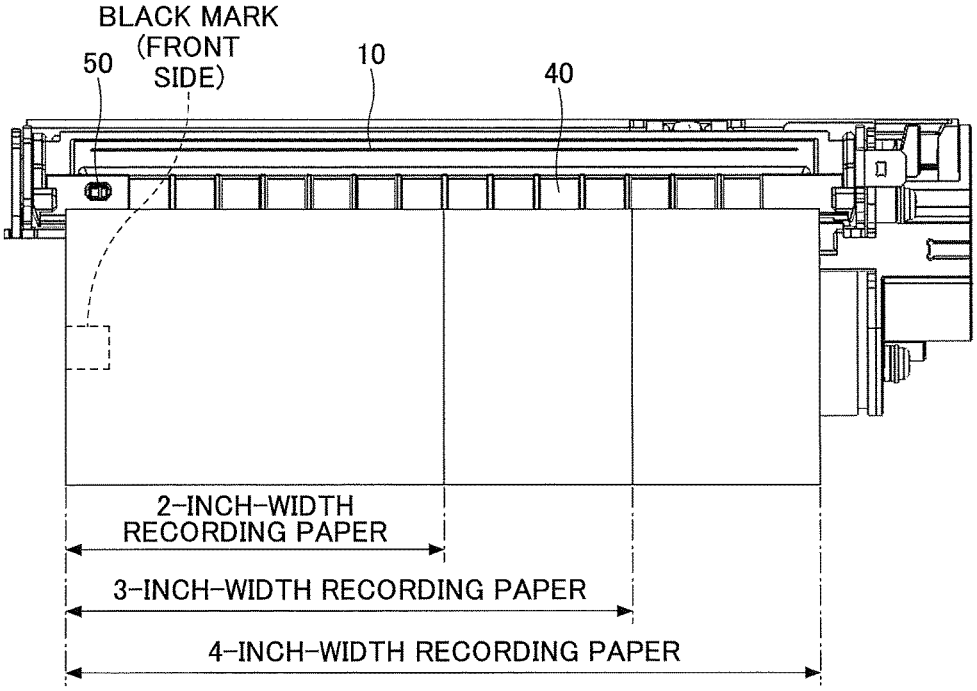
FIG. 2 is a drawing illustrating a case where recording media with different widths are used.
Figure 3:
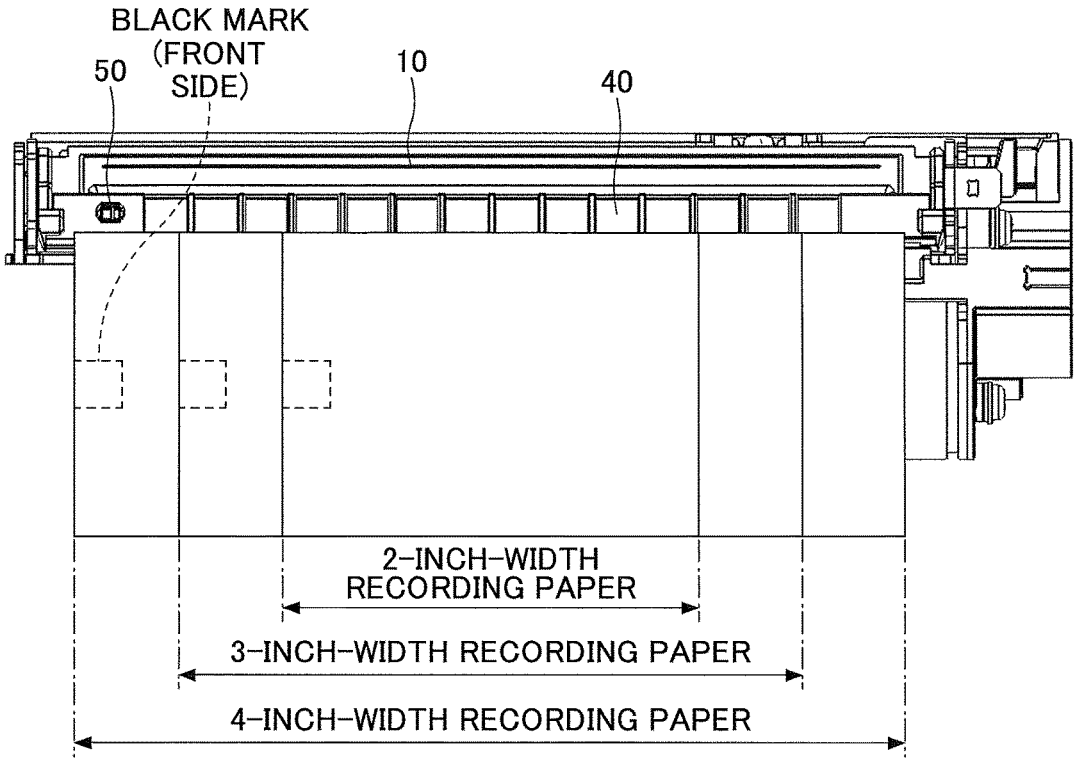
FIG. 3 is a drawing illustrating another case where recording media with different widths are used.

There are two methods to enable the same printer mechanism to use the four-inch medium, the three-inch medium, and the two-inch medium. A first method is to align the edges of the recording media with an end of a guide 40 as illustrated in FIG. 2, and a second method is to align the centers of the recording media with each other as illustrated in FIG. 3. As illustrated in FIGS. 2 and 3, the printer includes the guide 40 and a sensor 50. The guide 40 includes a hole at a position where the sensor 50 is provided. The sensor 50 is provided on the back side of the guide 40.

The sensor 50, an optical sensor for example, detects whether a recording medium is present and whether a black mark is present on the recording medium. A light-emitting element of the sensor 50 emits light. When a recording medium is present, the light is reflected by the recording medium. When no recording medium is present, the light is not reflected. Further, a portion of the recording medium where a black mark is printed and a portion of the recording medium where no black mark is printed have different reflectances. For these reasons, a first threshold and a second threshold greater than the first threshold are set for the sensor 50. When the sensor 50 detects light with intensity greater than or equal to the first threshold, the sensor 50 determines that a recording medium is present. When the intensity of the detected light is less than the first threshold, the sensor 50 determines that no recording medium is present. When the intensity of the detected light is greater than or equal to the first threshold and less than or equal to the second threshold, the sensor 50 determines that a black mark is detected. When the intensity of the detected light is greater than the second threshold, the sensor 50 determines that a portion of the recording medium where no black mark is printed is detected.

As illustrated in FIG. 2, in the case that the edges of the recording media are aligned with an end of the guide 40, one sensor 50 needs to be provided at the end of the guide 40. In this case, when a recording medium with a width of two or three inches is set in the printer, the recording medium is present between the thermal head 10 and the platen roller 20 in a portion of the print mechanism that is closer to the end of the guide 40 at which the sensor 50 is provided, but the recording medium is not present between the thermal head 10 and the platen roller 20 in a portion of the print mechanism that is closer to another end of the guide 40 at which the sensor 50 is not provided. Thus, a portion where the thermal head 10 and the platen roller 20 are in direct contact and the recording medium is not present is unevenly present in the width direction of the recording medium. As a result, the recording medium tends to be fed unevenly and skewed, and information may not be printed in a desired position on the recording medium.

This problem may be prevented by aligning the four-inch medium, the three-inch medium, and the two-inch medium at their centers as illustrated in FIG. 3. In this case, portions where the thermal head 10 and the platen roller 20 are in direct contact without the recording medium between them are present substantially evenly on the sides of the recording medium in the width direction. In this case, however, the sensor 50 provided at the end of the guide 40 can detect only the black mark on the four-inch medium, and cannot detect the black marks on the three-inch medium and the two-inch medium.

First Embodiment

A printer according to a first embodiment is described below.

The printer of the first embodiment can be adapted to detect black marks on recording media with different widths using one sensor even when the recording media are aligned at the centers.

Figure 4:
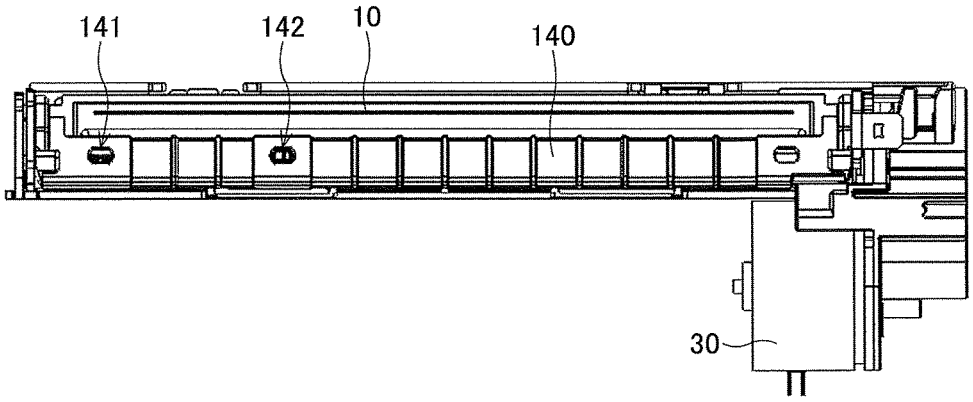
FIG. 4 is a drawing illustrating a printer of a first embodiment.
Figure 5A:
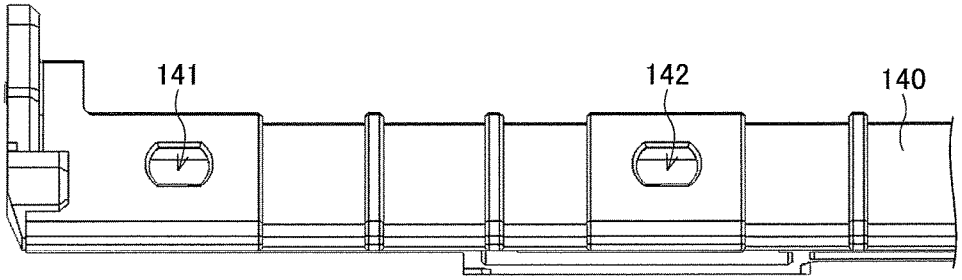
FIGS. 5A and 5B are drawings illustrating parts of the printer of the first embodiment.

In the first embodiment, as illustrated in FIGS. 4 and 5A, the printer includes a guide 140 in which multiple holes, a first hole 141 and a second hole 142 in this example, are formed to expose a sensor. For descriptive purposes, the first hole 141 is formed in a position corresponding to the position of the black mark on the four-inch medium, and the second hole 142 is formed in a position corresponding to the black mark on the two-inch medium. However, the number and positions of holes formed in the guide 140 are not limited to this example, and three or more holes for recording media with different widths may be formed in the guide 140.

Figure 5B:
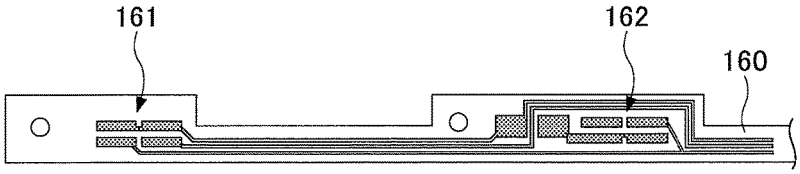

As illustrated in FIG. 5B, a board 160 onto which a sensor is mounted is provided on the back side of the guide 140. The board 160 includes multiple terminals, a first terminal 161 and a second terminal 162 in this example, on which a sensor can be mounted. Each of the first terminal 161 and the second terminal 162 includes multiple electrodes on which a sensor can be mounted. The board 160, for example, has wiring made of a metal covered by an insulator such as polyimide.

Figure 6A:
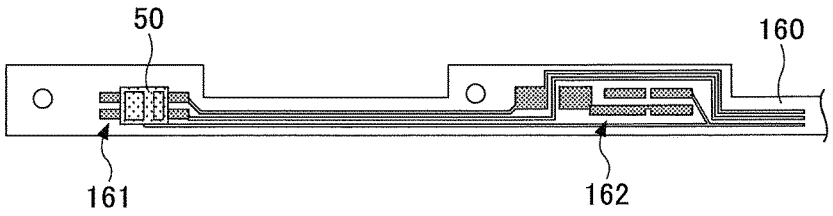
FIGS. 6A and 6B are drawings illustrating parts of the printer of the first embodiment.

In the first embodiment, a sensor is mounted on one of the first terminal 161 and the second terminal 162. To configure the printer to support the four-inch medium, a sensor 50 is mounted on the first terminal 161 as illustrated in FIG. 6A. In this case, the sensor 50 mounted on the board 160 is exposed through the first hole 141 and can detect the black mark on the four-inch medium. In the example of FIG. 6A, no sensor is mounted on the second terminal 162, and only one sensor 50 is used. When the sensor 50 is not mounted on the second terminal 162, a connection terminal connected to the wiring of the board 160 is not connected to a connection terminal of the second terminal 162. Therefore, even when the second terminal 162 is exposed through the second hole 142 and contacted by, for example, a metal object, it does not cause a malfunction or failure of the printer.

Figure 6B:
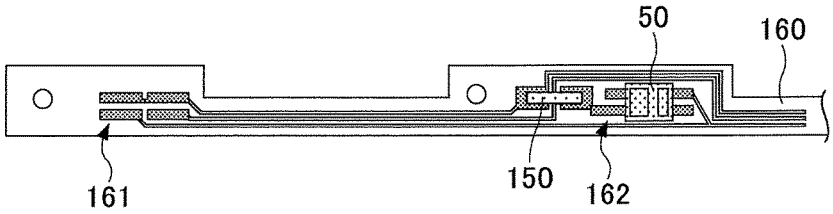
Figure 7:
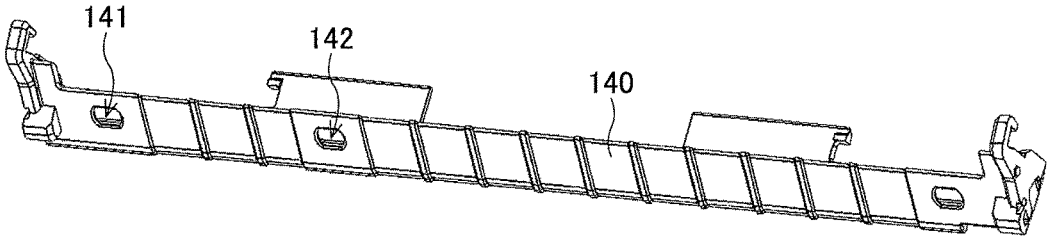
FIG. 7 is a drawing illustrating a guide of the printer of the first embodiment.

To configure the printer to support the two-inch medium, the sensor 50 is mounted on the second terminal 162 as illustrated in FIG. 6B. In this case, the connection terminal connected to the wiring of the board 160 is connected via a connection part 150 to the connection terminal of the second terminal 162 to electrically connect the second terminal 162 to the wiring, and the sensor 50 mounted on the board 160 becomes usable. With this configuration, the sensor 50 mounted on the board 160 is exposed through the second hole 142 and can detect the black mark on the two-inch-width recording medium. In the example of FIG. 6B, no sensor is mounted on the first terminal 161.

As described above, in the first embodiment, the first hole 141 and the second hole 142 for exposing the sensor 50 are formed in the guide 140, the first terminal 161 and the second terminal 162 are provided on the board 160, and the sensor 50 is mounted on one of the first terminal 161 and the second terminal 162. Therefore, the sensor 50 can be exposed through one of the first hole 141 and the second hole 142 selected depending on the width of a recording medium used. In other words, a multiple types of printers capable of supporting recording media with different widths can be produced by using the same printer mechanism. Also, because only one sensor 50 is mounted on the board 160, it is possible to produce multiple types of printers with low costs. The guide 140 may be formed of, for example, a resin such as an acrylonitrile butadiene styrene (ABS) resin, a sheet metal such as a stainless steel sheet, or a die-cast metal such as die-cast zinc (Zn).

In the printer described above, one of the first terminal 161 and the second terminal 162 which the sensor 50 is not mounted is exposed. When, for example, a metal object contacts the exposed terminal, it may cause a malfunction or failure.

Figure 8A:
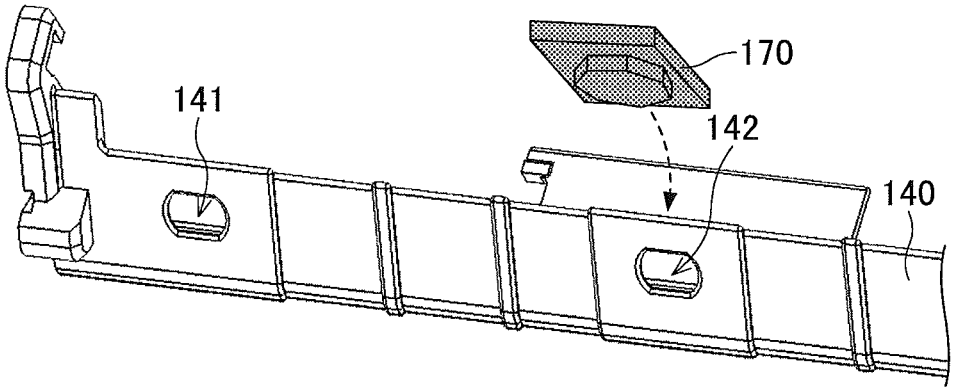
FIGS. 8A and 8B are drawings illustrating parts of the printer of the first embodiment.
Figure 8B:
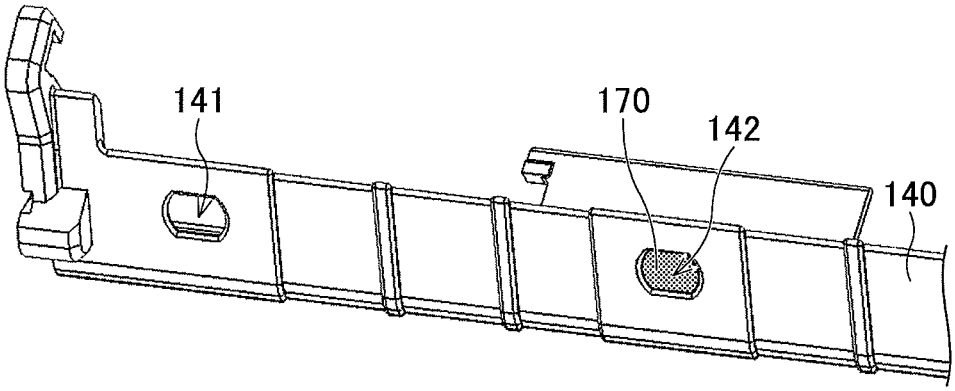

For this reason, in the first embodiment, a lid 170 is provided to close the first hole 141 or the second hole 142. When the sensor 50 is mounted on the first terminal 161, the second hole 142 is closed by the lid 170 as illustrated in FIGS. 8A and 8B. The lid 170 prevents the second terminal 162 from being exposed through the second hole 142. FIG. 8A illustrates a state before the second hole 142 is closed by the lid 170, and FIG. 8B illustrates a state where the second hole 142 is closed by the lid 170.

Figure 9A:
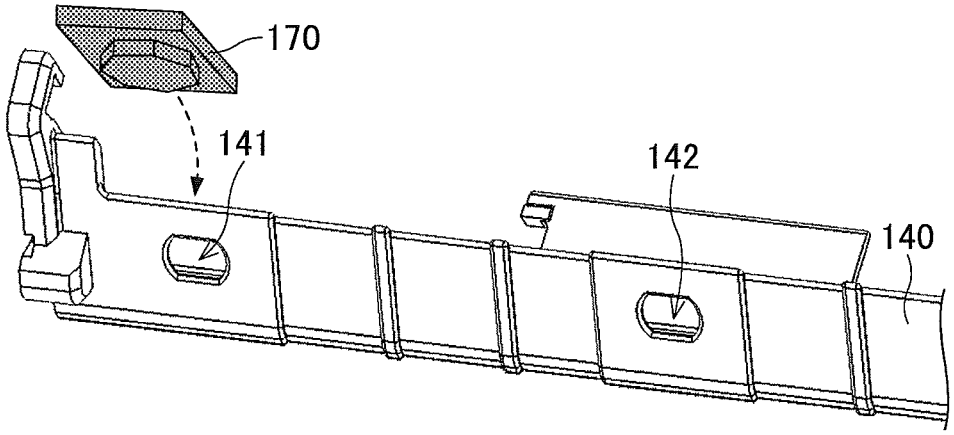
FIGS. 9A and 9B are drawings illustrating parts of the printer of the first embodiment.
Figure 9B:
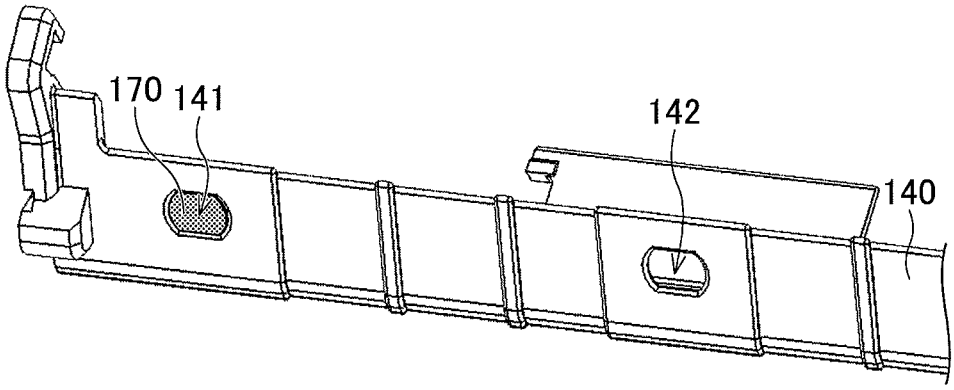

When the sensor 50 is mounted on the second terminal 162 as illustrated in FIG. 6B, the first hole 141 is closed by the lid 170 as illustrated in FIGS. 9A and 9B. The lid 170 prevents the first terminal 161 from being exposed through the first hole 141. FIG. 9A illustrates a state before the first hole 141 is closed by the lid 170, and FIG. 9B illustrates a state where the first hole 141 is closed by the lid 170.

As described above, by closing a hole with the lid 170, a malfunction or failure caused when, for example, a metal object contacts the terminal exposing through the hole can be prevented.

As a variation, the board 160 may be configured to include only one terminal onto which a sensor is mounted. In this case, the above-described effects of the first embodiment can be achieved by changing the position of a sensor according to the width of a recording medium.

Second Embodiment

Figure 10:
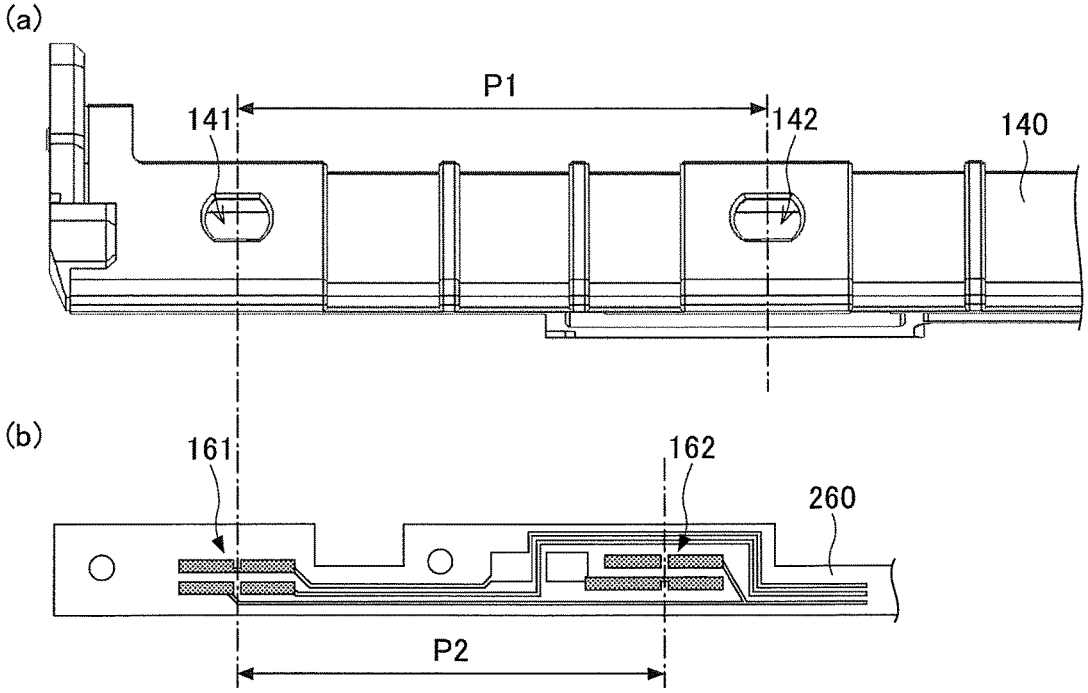
FIG. 10 is a drawing illustrating parts of a printer of a second embodiment.

Next, a second embodiment is described. As illustrated in FIG. 10, a printer of the second embodiment is configured such that a pitch P1 between the centers of the first hole 141 and the second hole 142 is different from a pitch P2 between the centers of a first terminal 161 and a second terminal 162.

Figure 11A:
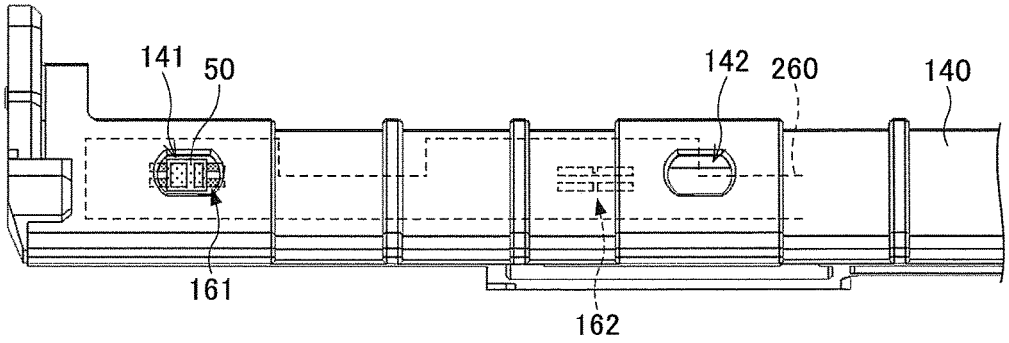
FIGS. 11A and 11B are drawings illustrating parts of the printer of the second embodiment.

When the sensor 5:0 is mounted on the first terminal 161, the board 260 is disposed such that sensor 50 is exposed through the first hole 141 as illustrated in FIG. 11A. In this case, the first hole 141 and the first terminal 161 are aligned with each other, but the second terminal 162 is hidden behind the guide 140 and is not exposed through the second hole 142.

Figure 11B:
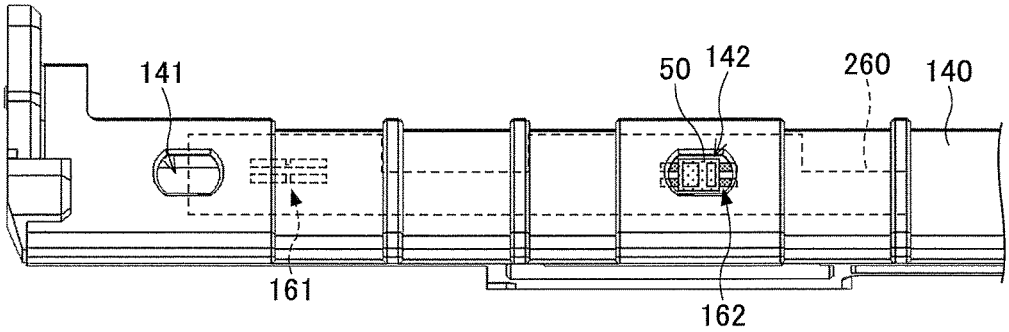

When the sensor 50 is mounted on the second terminal 162, the board 260 is disposed such that sensor 50 is exposed through the second hole 142 as illustrated in FIG. 11B. In this case, the second hole 142 and the second terminal 162 are aligned with each other, but the first terminal 161 is hidden behind the guide 140 and is not exposed through the first hole 141.

In the second embodiment, the pitch P2 between the first terminal 161 and the second terminal 162 is preferably shorter than the pitch P1 between the first hole 141 and the second hole 142 to prevent a problem where both of the first terminal 161 and the second terminal 162 are exposed through the first hole 141 and the second hole 142 due to, for example, a warp of the board 260. Also, reducing the pitch P2 between the first terminal 161 and the second terminal 162 can reduce the size of the board 160 and thereby reduce the costs of the printer.

The second embodiment can prevent a terminal onto which the sensor 50 is not mounted from being exposed through a hole, and prevent the terminal from being contacted by, for example, a metal object, without using a lid as in the first embodiment.

Other components and configurations of the printer of the second embodiment are substantially the same as those described in the first embodiment.

Third Embodiment

Figure 12:
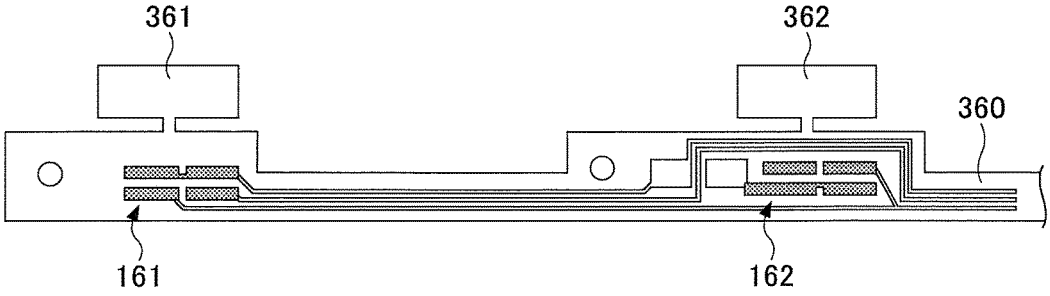
FIG. 12 is a drawing illustrating a board of a printer of a third embodiment.

Next, a third embodiment is described. In the third embodiment as illustrated in FIG. 12, a first protection part 361 is provided on the board 360 near a first terminal 161, and a second protection part 362 is provided near a second terminal 162. The first protection part 361 and the second protection part 362 are formed of an insulator such as polyimide that forms the board 360, and are larger than the first hole 141 and the second hole 142.

Figure 13A:
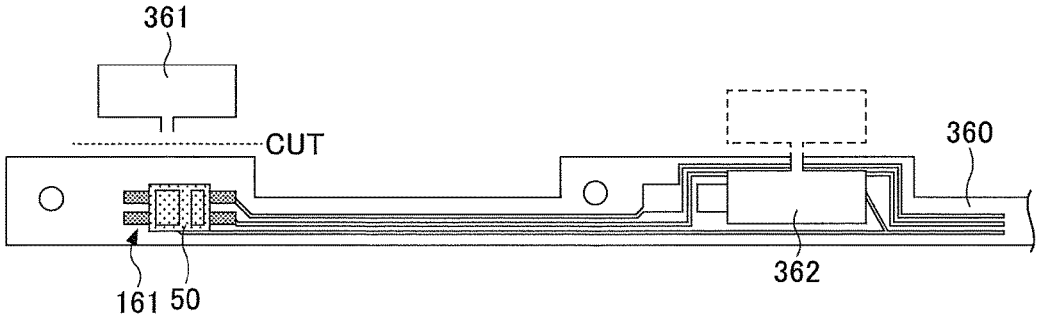
FIGS. 13A and 13B are drawings illustrating parts of the printer of the third embodiment.

When the sensor 50 is mounted on the first terminal 161, the second protection part 362 is bent to cover the second terminal 162 as illustrated in FIG. 13A. The second protection part 362 prevents the second terminal 162 from being exposed through the second hole 142. In this case, the first protection part 361 is not necessary, and may be cut off as illustrated in FIG. 13A, or bent to a side of the board 360 that is opposite the side on which the sensor 50 is mounted.

Figure 13B:
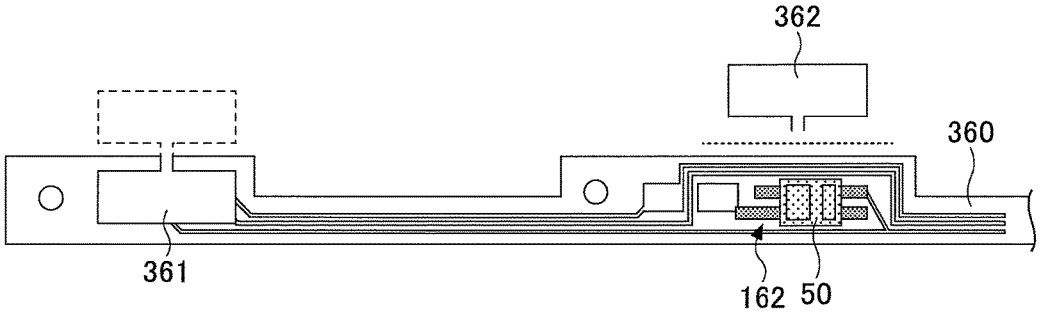

When the sensor 50 is mounted on the second terminal 162, the first protection part 361 is bent to cover the first terminal 161 as illustrated in FIG. 13B. The first protection part 361 prevents the first terminal 161 from being exposed through the first hole 141. In this case, the second protection part 362 is not necessary, and may be cut off as illustrated in FIG. 13B, or bent to a side of the board 360 that is opposite the side on which the sensor 50 is mounted.

Thus, in the third embodiment, a terminal on which no sensor is mounted is covered by a protection part to prevent the terminal from being exposed. Because the protection part and the board are formed as a monolithic part, it is not necessary to provide a separate cover to prevent a terminal being exposed. That is, the third embodiment can prevent a terminal from being exposed through a hole, and prevent the terminal from being contacted by a metal object without using a lid as in the first embodiment or without making a pitch between the holes of a guide differ from a pitch between terminals as in the second embodiment. Other components and configurations of the printer of the third embodiment are substantially the same as those described in the first embodiment.

Fourth Embodiment

Figure 14:
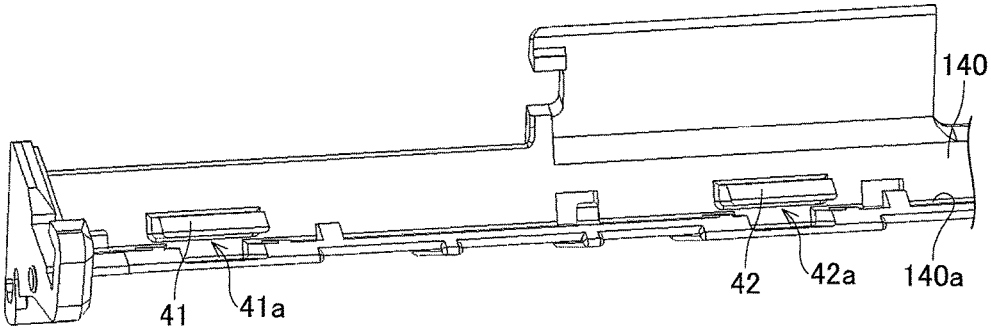
FIG. 14 is a drawing illustrating a guide of a fourth embodiment.

Next, a fourth embodiment is described. In the fourth embodiment as illustrated in FIG. 14, a protrusion 41 is provided on the guide 140 to face a back surface 140*a* of the guide 140 at a position corresponding to the first hole 141, and a protrusion 42 is provided on the guide 140 to face the back surface 140*a* at a position corresponding to the second hole 142. A board is placed on the guide 140 and inserted into a gap 41*a* between the back surface 140*a* and the protrusion 41 and a gap 42*a* between the back surface 140*a* and the protrusion 42. Using the guide 140, a portion of the board on which the sensor 50 is mounted may be placed between the back surface 140*a* and a protrusion so that the sensor 50 is exposed through a hole, and another portion of the board with a terminal may be disposed such that a protrusion is present between the board and a hole and the terminal is not exposed through the hole.

Figure 15:
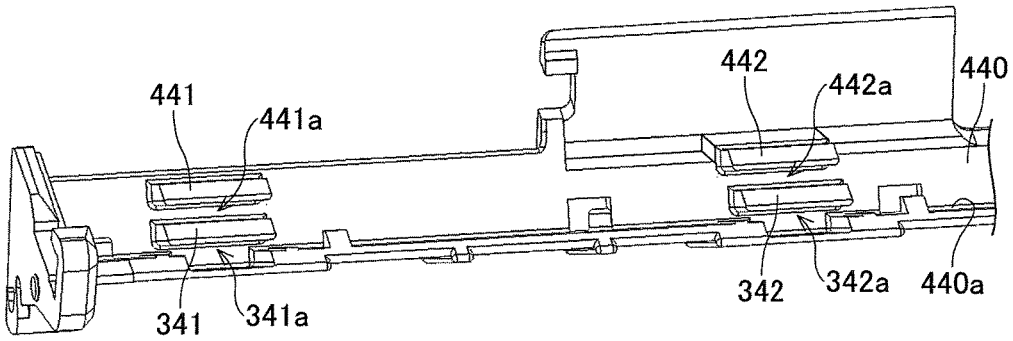
FIG. 15 is a drawing illustrating another guide of the fourth embodiment.

In the fourth embodiment, as illustrated in FIG. 15, a front protrusion 341 and a rear protrusion 441 are provided on a guide 440 to face a back surface 440*a* of the guide 440 at a position corresponding to the first hole 141, and a front protrusion 342 and a rear protrusion 442 are provided on the guide 440 to face the back surface 440*a* at a position corresponding to the second hole 142.

In the fourth embodiment, the front protrusion 341 is disposed closer to the first hole 141 than the rear protrusion 441 such that the front protrusion 341 is positioned between the first hole 141 and the rear protrusion 441. Also, the front protrusion 342 is disposed closer to the second hole 142 than the rear protrusion 442 such that the front protrusion 342 is positioned between the second hole 142 and the rear protrusion 442. In this embodiment, a gap 341*a* is formed between the back surface 440*a* and the front protrusion 341, and a gap 441*a* is formed between the front protrusion 341 and the rear protrusion 441. Also, a gap 342*a* is formed between the back surface 440*a* and the front protrusion 342, and a gap 442*a* is formed between the front protrusion 342 and the rear protrusion 442.

Figure 16A:
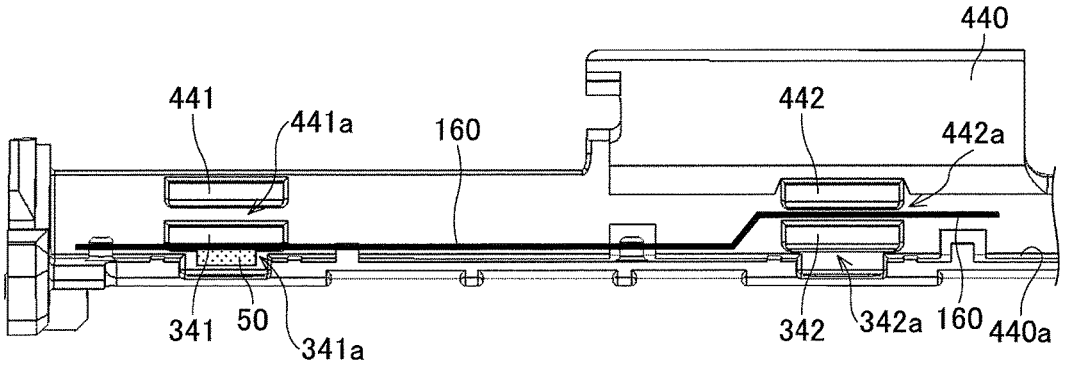
FIGS. 16A and 16B are drawings illustrating parts of a printer of the fourth embodiment.
Figure 16B:
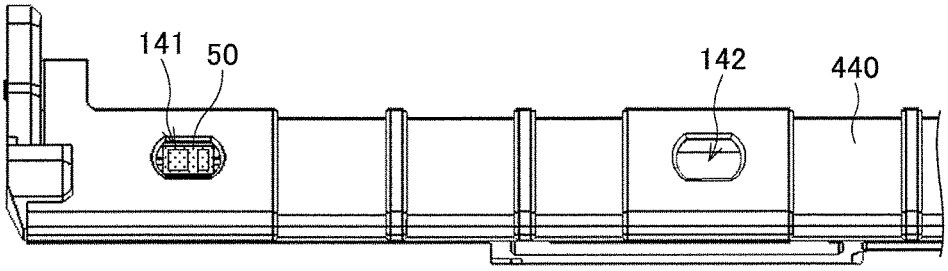

As illustrated in FIGS. 16A and 16B, when the sensor 50 is mounted on the first terminal 161, the board 160 is inserted into the gap 341*a* and the gap 442*a*. With this configuration, the sensor 50 is exposed through the first hole 141, but the second terminal 162 is hidden behind the front protrusion 342 and is not exposed through the second hole 142. FIG. 16A is a top view and FIG. 16B is a front view of this configuration.

Figure 17A:
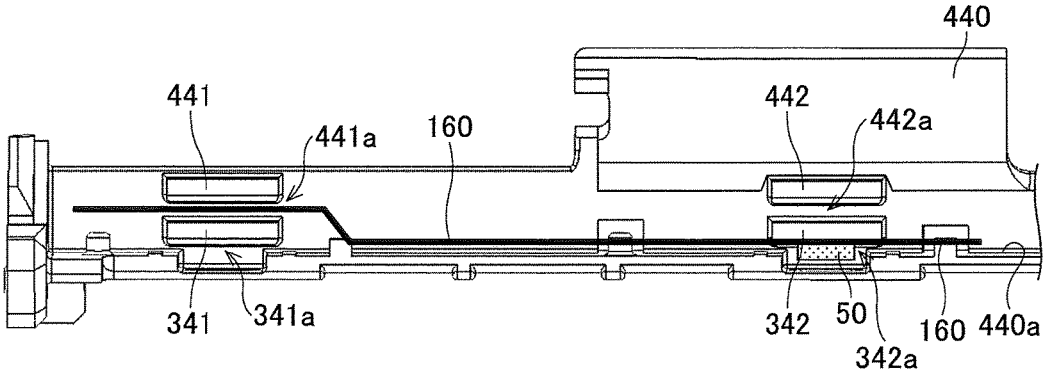
FIGS. 17A and 17B are drawings illustrating parts of the printer of the fourth embodiment.
Figure 17B:
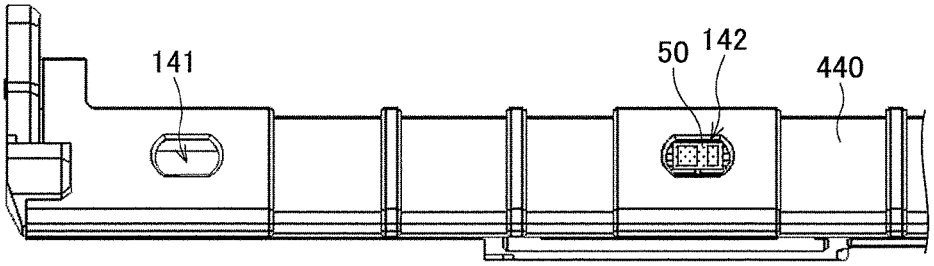

As illustrated in FIGS. 17A and 17B, when the sensor 50 is mounted on the second terminal 162, the board 160 is inserted into the gap 441*a* and the gap 342*a*. With this configuration, the sensor 50 is exposed through the second hole 142, but the first terminal 161 is hidden behind the front protrusion 341 and is not exposed through the first hole 141. FIG. 17A is a top view and FIG. 17B is a front view of this configuration.

Thus, according to the fourth embodiment, a portion of the board 160 on which the sensor 50 is mounted is placed between the back surface 440*a* and a front protrusion so that the sensor 50 is exposed through a hole, and another portion of the board 160 with a terminal is disposed between a front protrusion and a rear protrusion so that the terminal is not exposed through a hole. The gaps can also be used to fix the board 160 to the guide 440.

Fifth Embodiment

Figure 18A:
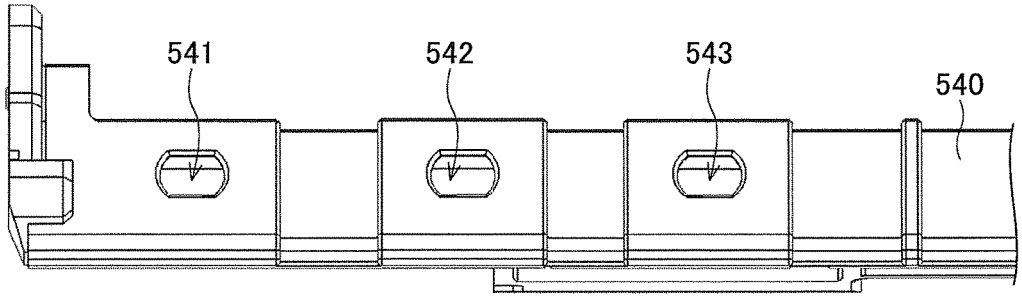
FIGS. 18A and 18B are drawings illustrating a printer of a fifth embodiment.
Figure 18B:
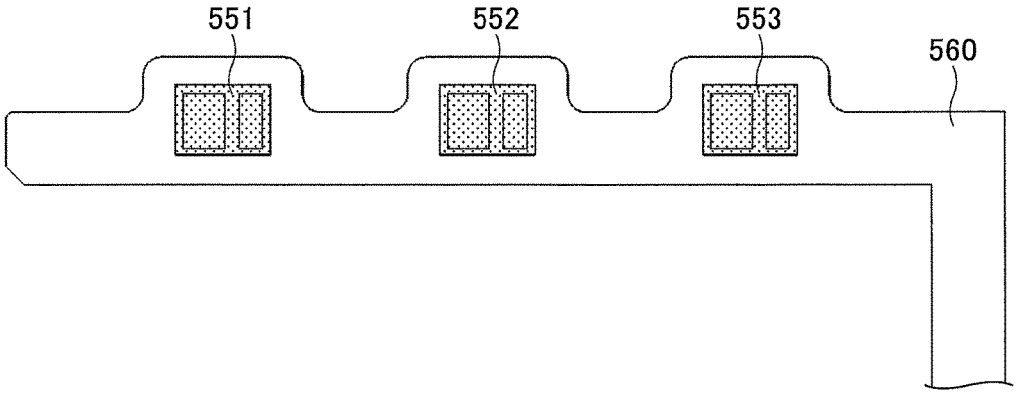

Next, a fifth embodiment is described. In the fifth embodiment, as illustrated in FIG. 18A, a guide 540 includes a first hole 541, a second hole 542, and a third hole 543. Also, as illustrated in FIG. 18B, a first sensor 551, a second sensor 552, and a third sensor 553 are provided on a substrate 560. The first sensor 551 is exposed through the first hole 541, the second sensor 552 is exposed through the second hole 542, and the third sensor 553 is exposed through the third hole 543. In this embodiment, recording media with different widths can be detected.

For example, the first sensor 551 can detect marks on the four-inch medium, the second sensor 552 can detect marks on the three-inch medium, and the third sensor 553 can detect marks on the two-inch medium. In the fifth embodiment, multiple sensors corresponding to different recording medium widths are exposed through holes of a guide by default. In this embodiment, types of printers that need to be produced to support different recording medium widths can be reduced.

In the fifth embodiment where sensors are mounted on respective terminals and exposed through holes of a guide, a printer can detect recording media with various widths. Although sensors are mounted on all terminals in the above-described example, sensors may be selectively mounted on some of the terminals. Also, to prevent exposure of terminals on which no sensor is mounted, holes may be closed or the terminals may be covered as in the other embodiments.

According to an aspect of this disclosure, printers which support recording media with different widths and can detect black marks printed on the recording media can be produced by using the same printer mechanism.

Printers according to embodiments of the present invention are described above. However, the present invention is not limited to the specifically disclosed embodiments, and variations and modifications may be made without departing from the scope of the present invention.

What is claimed is:

1. A printer for printing information on a recording medium, the printer comprising:

a guide that guides the recording medium being fed and includes multiple holes;

a sensor for detecting the recording medium; and a board that includes multiple sensor-mounting terminals each of which is for mounting the sensor thereon, wherein the sensor is mounted on at least one of the sensor-mounting terminals such that the sensor is exposed through one of the holes.

2. The printer as claimed in claim 1, wherein one or more of the holes not exposing the sensor are closed.

3. The printer as claimed in claim 1, wherein a pitch between the holes of the guide is different from a pitch between the sensor-mounting terminals of the board.

4. The printer as claimed in claim 1, wherein the board includes one or more protection parts; and one or more of the sensor-mounting terminals on which the sensor is not mounted are covered by the protection parts.

5. The printer as claimed in claim 1, further comprising:

protrusions formed on the guide to face a back surface of the guide at positions corresponding to the holes, wherein the one of the sensor-mounting terminals on which the sensor is mounted is placed between the back surface of the guide and one of the protrusions.

6. The printer as claimed in claim 1, wherein the board includes wiring and a first connection terminal connected to the wiring;

at least one of the sensor-mounting terminals includes a second connection terminal; and the second connection terminal is connected to the first connection terminal of the board to connect the at least one of the sensor-mounting terminals to the wiring.

* * * * *